US009670737B2

(12) United States Patent
Berube et al.

(10) Patent No.: US 9,670,737 B2
(45) Date of Patent: Jun. 6, 2017

(54) MUD MOTOR WITH INTEGRATED REAMER

(71) Applicant: FIRST CHOICE DRILLING, Calgary (CA)

(72) Inventors: Vincent Gille Berube, Okotoks (CA); Kevin Kalman, Okotoks (CA); Aaron W. Logan, Calgary (CA)

(73) Assignee: First Choice Drilling, Calgary (CA)

( * ) Notice: Subject to any disclaimer, the term of this patent is extended or adjusted under 35 U.S.C. 154(b) by 0 days.

(21) Appl. No.: 14/898,390

(22) PCT Filed: Jul. 4, 2014

(86) PCT No.: PCT/CA2014/050643

§ 371 (c)(1),
(2) Date: Dec. 14, 2015

(87) PCT Pub. No.: WO2015/003267

PCT Pub. Date: Jan. 15, 2015

(65) Prior Publication Data

US 2016/0138341 A1 May 19, 2016

Related U.S. Application Data

(60) Provisional application No. 61/843,355, filed on Jul. 6, 2013.

(51) Int. Cl.
*E21B 10/26* (2006.01)
*E21B 4/02* (2006.01)
(Continued)

(52) U.S. Cl.
CPC ..... *E21B 10/26* (2013.01); *E21B 4/02* (2013.01); *E21B 7/28* (2013.01); *E21B 10/30* (2013.01)

(58) Field of Classification Search
CPC ..... E21B 10/26; E21B 10/28; E21B 10/30; E21B 4/02; E21B 7/28; E21B 17/10;
(Continued)

(56) References Cited

U.S. PATENT DOCUMENTS 2,088,770 A * 8/1937 Skinner ..... E21B 10/26 175/320
4,226,291 A * 10/1980 Spelts ..... E21B 10/30 175/325.3

(Continued)

FOREIGN PATENT DOCUMENTS

| | | | |
|---|---|---|---|
| CA | 2756010 | A1 | 9/2010 |
| WO | 2010151796 | A2 | 12/2010 |
| WO | 2013052554 | A1 | 4/2013 |

*Primary Examiner* — Wei Wang
(74) *Attorney, Agent, or Firm* — Oyen Wiggs Green & Mutala LLP

(57) ABSTRACT

A mud motor has integrated rotatable reamer elements. The reamer elements may be located directly radially outwardly of a rotor of the mud motor on an outer surface of the mud motor. The reamer elements may be applied to provide one or more of sizing a wellbore, smoothing a wellbore and stabilizing a bottom hole assembly and/or drill bit during drilling. The reamer elements may project from pockets formed in an outside surface of the mud motor. Axes of rotation of the reamer elements may be parallel to and/or skewed relative to a longitudinal centerline of the mud motor. Reamer devices that connect at couplings between drill string sections may be used together with the mud motor or applied separately of the mud motor. The reamer devices include inwardly-projecting elements that engage gaps between the drill string sections.

13 Claims, 15 Drawing Sheets

(51) Int. Cl.
*E21B 10/30* (2006.01)
*E21B 7/28* (2006.01)

(58) Field of Classification Search
CPC ..... E21B 17/1057; E21B 17/1064; E21B 17/1078; E21B 17/1085; E21B 17/22
See application file for complete search history.

(56) References Cited

U.S. PATENT DOCUMENTS

| | | | |
|---|---|---|---|
| 4,385,669 | A | 5/1983 | Knutsen |
| 4,480,704 | A | 11/1984 | May et al. |
| 4,508,184 | A | 4/1985 | Hansen |
| 4,862,974 | A | 9/1989 | Warren et al. |
| 5,649,603 | A | 7/1997 | Simpson et al. |
| 6,470,977 | B1 | 10/2002 | Chen et al. |
| 6,848,518 | B2 | 2/2005 | Chen et al. |
| 7,562,725 | B1 | 7/2009 | Broussard et al. |
| 2004/0099444 | A1 | 5/2004 | Chen et al. |
| 2006/0207796 | A1 | 9/2006 | Stewart |
| 2006/0237234 | A1 | 10/2006 | Dennis et al. |
| 2010/0096189 | A1 | 4/2010 | Salzer, III et al. |
| 2010/0326731 | A1 | 12/2010 | Swietlik et al. |
| 2011/0240370 | A1 | 10/2011 | Shwets et al. |
| 2012/0279784 | A1 | 11/2012 | Harvey et al. |
| 2013/0092444 | A1 | 4/2013 | Taghipour Khadrbeik |

* cited by examiner

MUD MOTOR WITH INTEGRATED REAMER

CROSS-REFERENCE TO RELATED APPLICATIONS

This application claims priority from U.S. Application No. 61/843,355 filed 6 Jul. 2013. For purposes of the United States, this application claims the benefit under 35 U.S.C. §119 of U.S. Application No. 61/843,355 filed 6 Jul. 2013 and entitled MUD MOTOR WITH INTEGRATED REAMER which is hereby incorporated herein by reference for all purposes.

TECHNICAL FIELD

This application relates to subsurface drilling, specifically to mud motors. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface.

Bottom hole assembly (BHA) is the name given to the equipment at the terminal end of a drill string. In addition to a drill bit, a BHA may comprise elements such as: apparatus for steering the direction of the drilling; sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Instead of driving a drill bit by rotating the entire drill string from the surface a drill bit may be driven by a mud motor. A mud motor is driven by the flow of drilling fluid through the drill string. Mud motors must work in harsh downhole environments. WO 2010/106335 describes a drill motor equipped with stabilizer blades that carry reaming blocks of diamond-impregnated tungsten carbide material along longitudinal edges of the blades.

As drilling progresses, especially where the formation being drilled is very hard, the drill bit can wear. The diameter of the wellbore being drilled may be reduced as the drill bit becomes worn. Reamer tools may be subsequently used to expand the wellbore to a required diameter. Reamer tools may be connected at various locations in the drill string. For example, U.S. Pat. No. 7,562,725 describes a reamer located between a mud motor and a drill bit.

Other references describing reamers of various types for downhole applications include: CA 2756010; US 2004/0099444; US 2006/0207796; US 2006/0237234; US 2010/0096189; US 2010/0326731; US 2011/0240370; US 2012/0279784; US 2013/0092444; U.S. Pat. No. 6,470,977; U.S. Pat. No. 6,848,518; U.S. Pat. No. 5,649,603; U.S. Pat. No. 4,480,704; WO 2010/151796; and, WO 2013/052554.

There remains a need for alternative tools and methods for subsurface drilling.

SUMMARY

This invention provides mud motors having integrated rotary reamers. The reamers may assist in sizing a wellbore to a desired size and/or stabilizing a drill bit and/or reducing a roughness of the wall of a wellbore. Such reamers can assist in providing a smoother wellbore that assists in sliding of a drill string while directional drilling. Providing reaming elements on the outer surface of a mud motor can provide stabilization close to a drill bit while allowing the drill bit to be mounted close to the mud motor. Such reaming elements can also provide reaming of the entire well bore as a drill string is tripped out of the wellbore.

One aspect of the invention provides a mud motor useable for downhole drilling. The mud motor comprises a body having a coupling at a downhole end thereof for coupling to a drill bit; and a plurality of reamer elements rotatably mounted on an outer surface of the body. In some embodiments the reamer elements of the plurality of reamer elements are each mounted in a corresponding pocket in the outer surface of the body and each project radially outwardly from the corresponding pocket. The reamer elements of the plurality of reamer elements may be each supported for rotation on a shaft extending across the corresponding pocket.

In some embodiments the plurality of reamer elements include a group of three or more reamer elements spaced apart from one another around a circumference of the body. The reamer elements in the group of reamer elements may be uniformly spaced apart around the circumference of the body. Radially outermost points of the reamer elements in the group of reamer elements may lie on a circle centered on a longitudinal centerline of the mud motor. A drill bit may be coupled to the coupling. In some embodiments the drill bit has an outer diameter equal to a diameter of the circle (i.e. the reamer elements are arranged to ream the borehole to a size equal to a gauge diameter of the drill bit).

The rotary reamer elements may have various forms. In some embodiments the reamer elements comprise roller reamer cutters. The roller reamer cutters may be inserted with hard materials such as tungsten carbide, diamond-containing bodies, or the like.

In some embodiments the reamer elements of the plurality of reamer elements are mounted to rotate about parallel axes. The parallel axes may be parallel to a longitudinal centerline of the mud motor. In some other embodiments the reamer elements of the plurality of reamer elements are mounted to rotate about axes that are skewed with respect of a longitudinal centerline of the mud motor. In other embodiments different ones of the reamer elements are mounted to rotate about axes oriented in different directions.

In some embodiments the mud motor comprises a rotor running within a stator and the plurality of reamer elements are directly radially outward of the rotor.

In some embodiments the outer surface of the body comprises a tubular member removably affixed to the mud motor.

Another aspect of the invention provides a downhole mud motor comprising a body having coupling at a downhole end thereof for coupling a drill bit; and a plurality of pockets formed on an outer surface of the body. Each of the plurality of pockets is adapted to receive a shaft that extends across the corresponding pocket. In some embodiments, a reamer element is rotatably mounted on the shaft received in each of the plurality of pockets. Each of the reamer elements projects radially outward from the corresponding pocket of the plurality of pockets.

In some embodiments the plurality of pockets include a group of three or more pockets spaced apart from one another around a circumference of the body. The group of pockets may be uniformly spaced apart the circumference of the body. Radially outermost points of the reamer element in each of the plurality of pockets may lie on a circle centered on a longitudinal centerline of the mud motor. A drill bit may be coupled to the coupling. In some embodiments, the drill bit has an outer diameter equal to a diameter of the circle.

In some embodiments the reamer element may comprise roller reamer cutters. The roller reamer cutters may be inserted with hard material such as tungsten carbide, diamond-containing bodies, or the like.

In some embodiments each of the shafts, received in the corresponding pocket of the plurality of pockets, lies on parallel axes. The parallel axes may be parallel to a longitudinal centerline of the mud motor. In some embodiments the parallel axes may be skewed with respect to the longitudinal centerline of the downhole mud motor.

In some embodiments the body comprises a stator of the mud motor and the outer surface of the body comprises a tubular member removably affixed to the stator. The downhole mud motor may further comprise a rotor running within the stator. The plurality of pockets may be formed in an outer surface of the tubular member. In other embodiments the body comprises a plurality of tubular members removable affixed to the downhole mud motor, where the plurality of pockets are formed in outer surfaces of the plurality of tubular members.

Another aspect provides a reamer device comprising a reamer body carrying one or more radially-outwardly-facing reamer surfaces. The reamer body has a bore extending therethrough. The bore comprises first and second inner surfaces respectively dimensioned to receive first and second drill string sections. A radially-inwardly-projecting member is located within the bore between the first and second inner surfaces.

The reamer device may be assembled onto a joint between the first and second drill string sections. The first drill string section comprises a first coupling element engaged to a second coupling element of the second drill string section to provide a gap at the joint. The gap may comprise, for example, a circumferential groove at the joint, one or more pockets formed at the joint between the first and second drill string sections or the like The radially-inwardly-projecting member of the reamer device projects into the gap.

In some embodiments, at least one of the first and second drill string sections comprises a drill collar or a mud motor. In some embodiments the reamer device has internal threads engaging external threads on the drill collar or mud motor.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
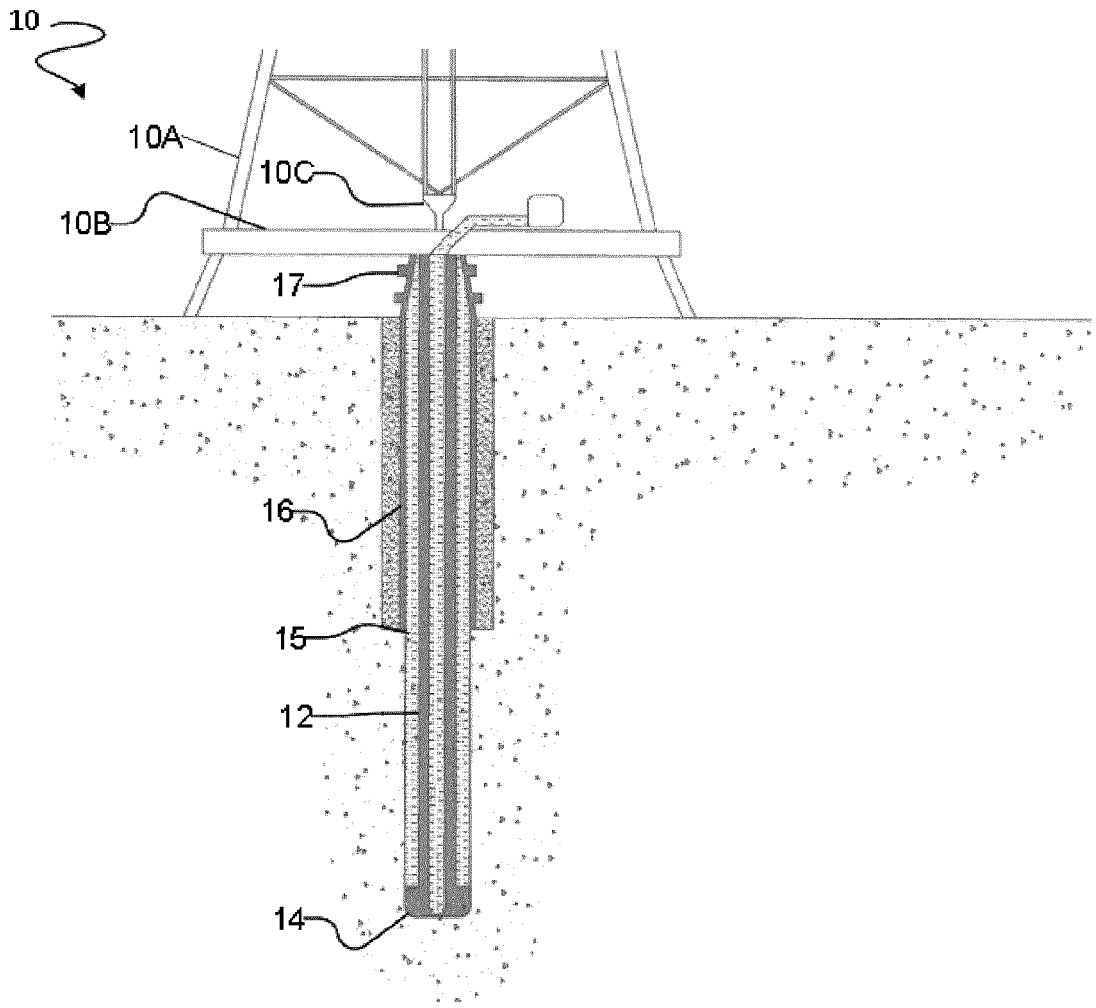
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Figure 1A:
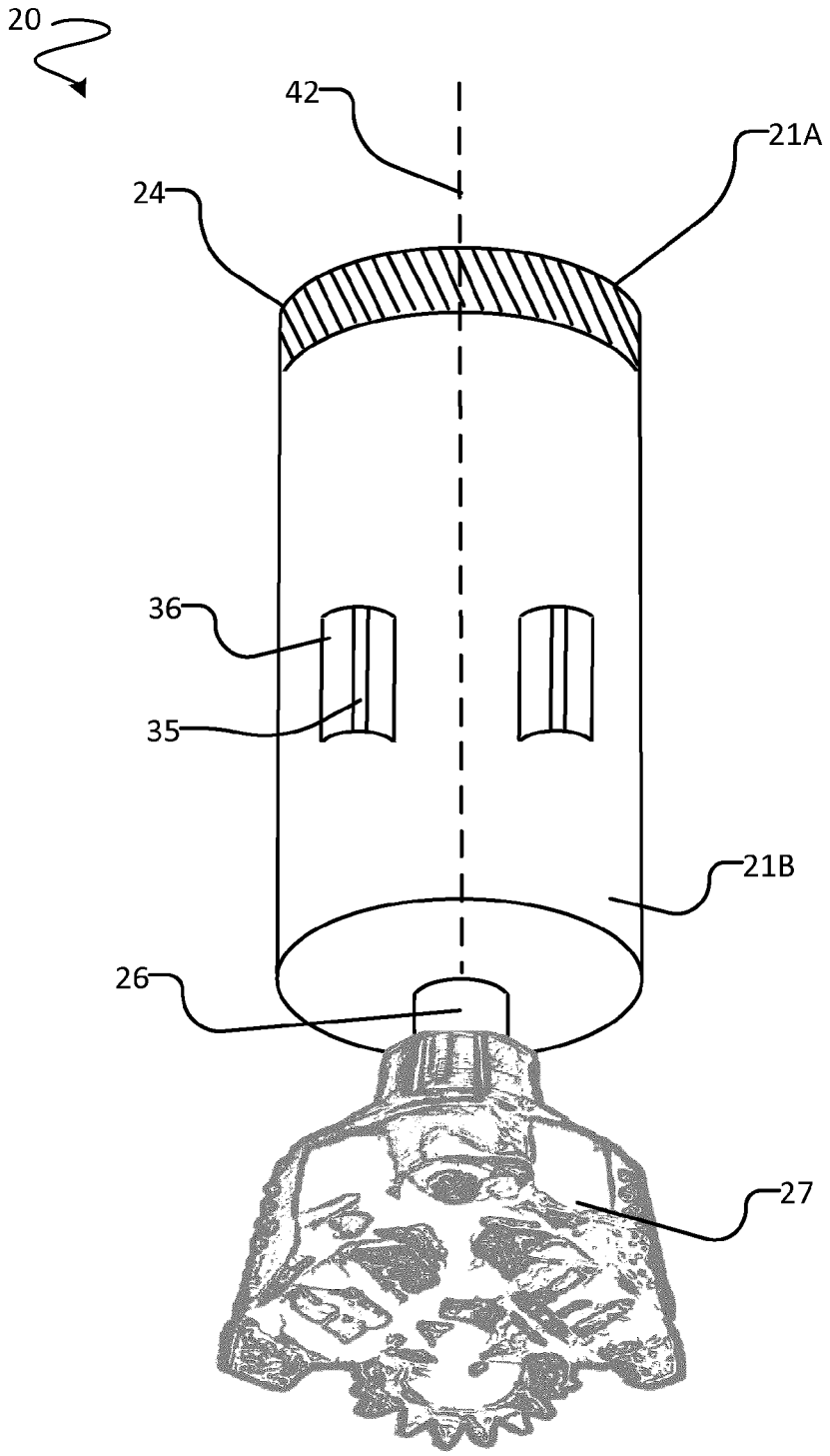
FIG. 1A is a schematic perspective view showing a mud motor according to an embodiment of the invention.
Figure 2:
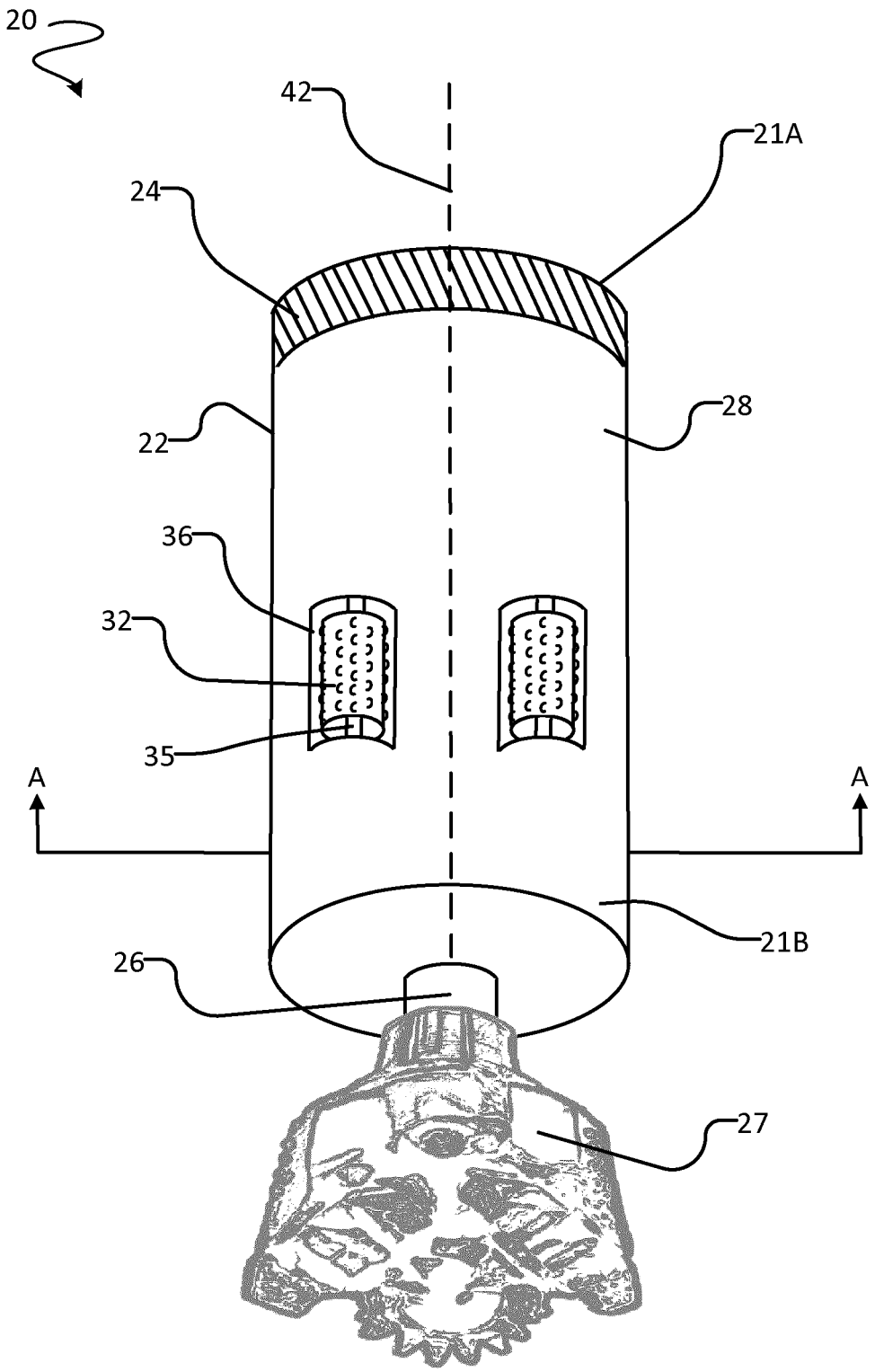
FIG. 2 is a schematic view showing the mud motor in FIG. 1A having integrated rotary reamer elements.

FIGS. 1A and 2 show a mud motor 20 according to an example embodiment. Mud motor 20 comprises a body 22 having a coupling 24 at an uphole end 21A thereof for coupling to a drill string. Coupling 24 may, for example, comprise an API standard threaded connection.

A rotatable coupling 26 is provided at a downhole end 21B of mud motor 20. A drill bit 27 may be coupled to rotatable coupling 26. Mud motor 20 comprises a rotor inside body 22 (rotor not shown in FIGS. 1A and 2) that is coupled to turn rotatable coupling 26 when driven by a flow of drilling fluid through mud motor 20.

Figure 3:
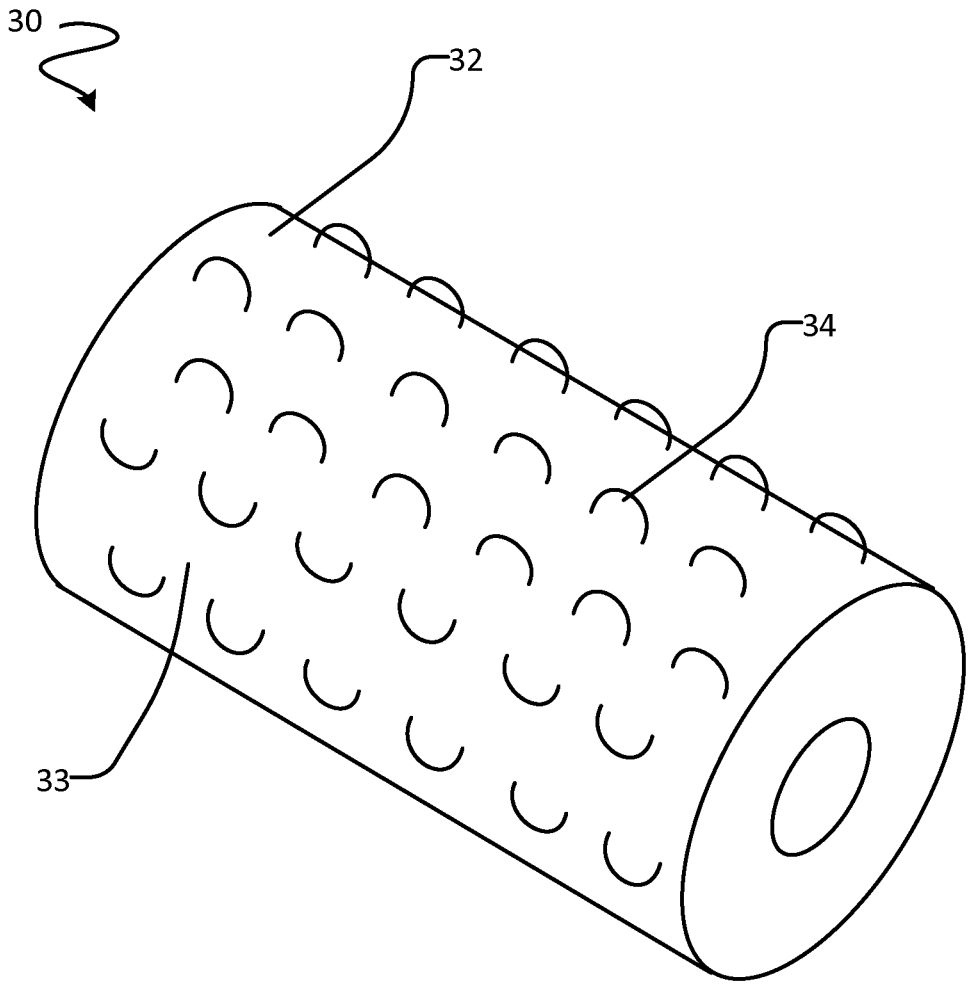
FIG. 3 is a schematic perspective view showing a reamer element according to an embodiment of the invention.

A plurality of reamer mechanisms 30 are mounted on the outside surface 28 of body 22 between ends 21A and 21B, see FIG. 2. FIG. 3 illustrates an example reamer mechanism 30. Reamer mechanism 30 comprises a rotatable reamer element 32. In the illustrated embodiment, reamer element 32 comprises a generally cylindrical body having an outer surface 33 textured with hardened protrusions 34. Protrusions 34 may, for example, comprise tips of inserted bodies of a hard durable material such as a suitable grade of tungsten-carbide, diamond-carbide, or the like.

Reamer element 32 may have a reduced diameter at either end. The specific shape of reamer element 32 may be varied widely. For example, in longitudinal cross-section the surface of reamer element 32 may follow an arc of a circle, an ellipse, a trapezoid, be generally pine-cone shaped etc.

Reamer element 32 is mounted for rotation on a shaft 35 that extends across a pocket 36 in outside surface 28 of body 22. The part of reamer element 32 that is radially outermost relative to the longitudinal centerline of mud motor 20 projects radially outwardly from outside surface 28.

Figure 2A:
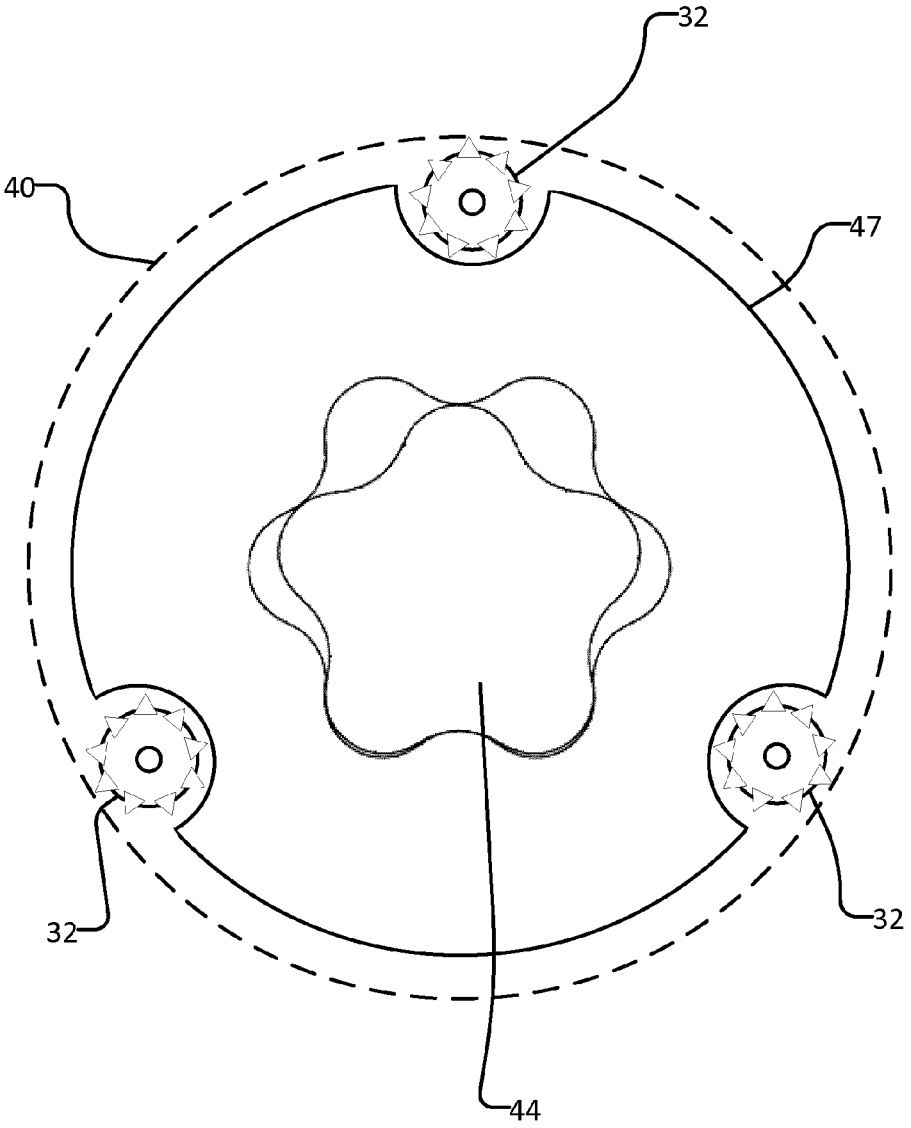
FIG. 2A is a schematic cross sectional view showing the mud motor in FIG. 2 along plane A-A.

As shown in FIG. 2A, a group of reamer mechanisms 30 may be spaced apart around the circumference of mud motor 20 such that the radially outermost parts of reamer elements 32 lie on a common circle 40. Circle 40 may be centered on longitudinal centerline 42 of mud motor 20. Circle 40 may have a diameter equal or substantially equal to the gauge diameter of drill bit 27.

In some embodiments, the group of reamer mechanisms 30 spaced apart around circle 40 comprises three to seven reamer mechanisms with three to five reamer mechanisms being most practical for many applications. One illustrative embodiment has three reamer mechanisms. Another illustrative embodiment has six reamer mechanisms spaced circumferentially around the circumference of mud motor 20. Three reamer mechanisms are shown spaced equally apart around circle 40 in FIG. 2A. In some embodiments two or more such groups of reamer mechanisms 30 are spaced longitudinally apart from one another along body 22 of mud motor 20. The reamer mechanisms 30 in different groups may optionally be rotated relative to one another around mud motor body 22. Reamer mechanisms 30 in different groups may be staggered relative to one another and/or may include different numbers of reamer elements. In some embodiments three or four groups of reamer mechanisms 30 are provided at locations spaced apart along body 22 of mud motor 20.

Providing a plurality of groups of reamer mechanisms 30 spaced apart along mud motor 20 may prevent flexing of mud motor 20. This can be advantageous because flexing can cause wear and damage to a mud motor. In some applications, however, flexing is desired. In certain directional drilling applications, for example, it can be desirable to allow the stator of a mud motor to flex. For use in such applications, some reamer mechanisms 30 may be dismounted. For example, a mud motor for certain directional drilling operations may be used with only one group of reamer mechanisms 30 located close to the end of mud motor 20 at which drill bit 27 is coupled.

Figure 2B:
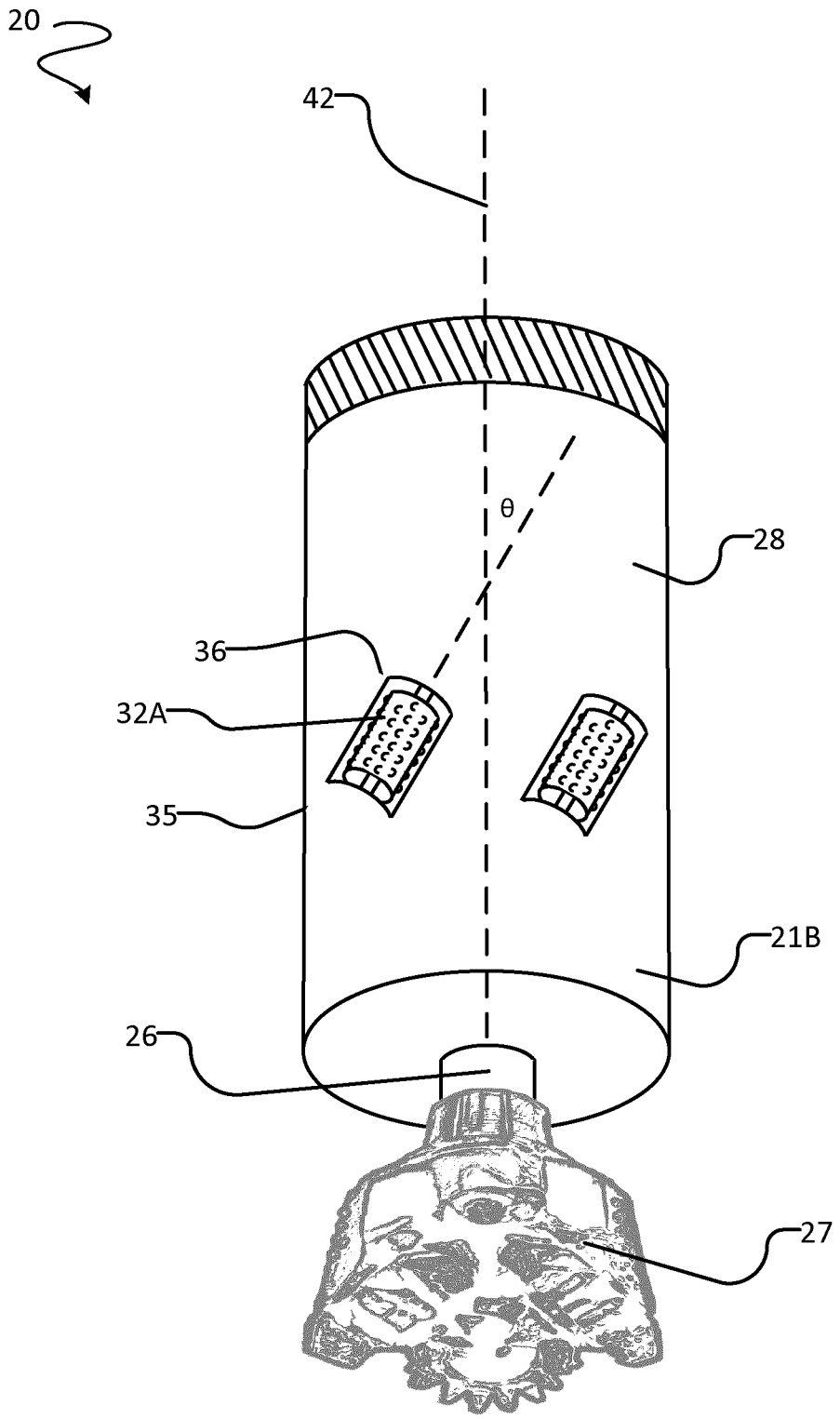
FIG. 2B is a schematic perspective view showing a mud motor having integrated rotary reamer elements according to another embodiment of the invention.

The axes of rotation of reamer elements 32 may be, but are not necessarily parallel to one another. In some embodiments the axes of rotation of some or all reamer elements 32 are parallel to longitudinal centerline 42 of mud motor 20. In some embodiments, the axes of rotation of some or all reamer elements 32 are skewed relative to the longitudinal centerline of mud motor 20. FIG. 2B shows an example in which the axis of rotation of a specific reamer element 32A is skewed at an angle θ to longitudinal centerline 32. In some embodiments θ is in the range of about 0 degrees to about 40 degrees.

In some embodiments the reamer elements are mounted at a skew angle that matches a typical helix angle followed during drilling. For example, the appropriate skew angle is given approximately by $\theta=\sin^{-1}(P/\pi DS)$, where P is the penetration rate, D is the diameter of the wellbore after reaming, and S is the rotation rate. In a case where the drill bit is rotated at 50 RPM with a penetration rate of 10 m/minute and the borehole is 30 cm in diameter, this gives a skew angle of approximately 13 degrees.

The dimensions of reamer elements 32 may be varied. It is not mandatory that all of reamer elements 32 be the same size. In an example embodiment, reamer elements 32 are approximately 2 inches (about 5 cm) in diameter. In an example embodiment, reamer elements 32 are approximately 6 inches long. The dimensions of reamer elements 32 should be selected taking into consideration the diameter of mud motor 20 as well as the cross sectional area desired for the flow of drilling fluid in the annular region outside of mud motor 20.

In some embodiments longitudinal or helical grooves or channels are cut into outer surface 28 of mud motor 20 Such grooves or channels provide increased area for the flow of drilling fluid past mud motor 20.

Figure 3A:
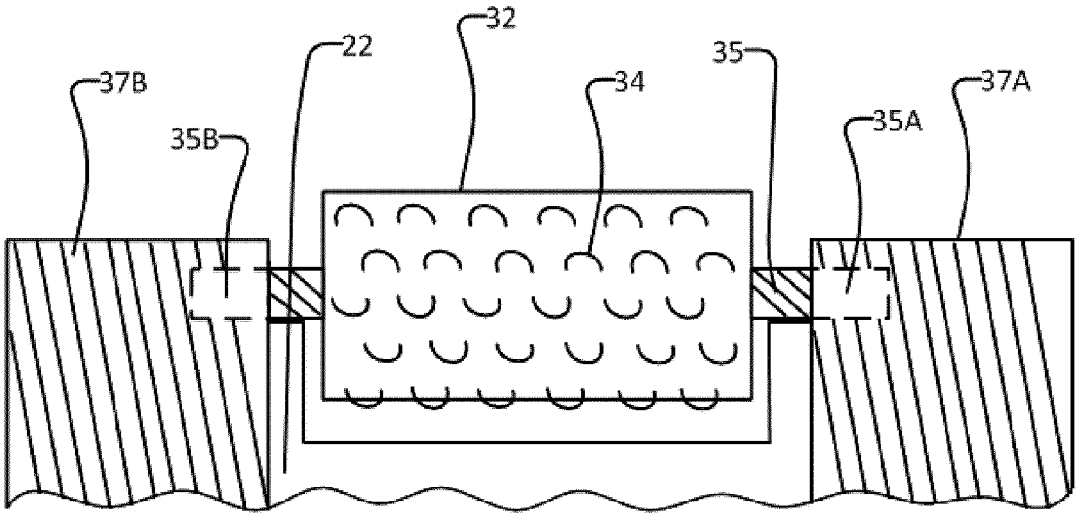
FIG. 3A is a schematic side cutaway view showing a mud motor having integrated rotary reamer elements according to another embodiment of the invention.

Reamer mechanisms 30 are preferably constructed to permit replacement of reamer elements 32. FIG. 3A shows an example embodiment in which ends 35A and 35B of shafts 35 holding reamer elements 32 are releasably retained by collars 37A and 37B mounted for longitudinal movement along body 22. Collars 37A and 37B may, for example, be threadedly engaged to body 22 and/or held in place to retain shafts 35 by pins, screws or the like.

In some embodiments, reamer mechanisms 30 are mounted on a component that is removable from the stator of mud motor 20. The component may, for example, comprise a tubular sleeve clamped or otherwise attached to the stator. The component may have substantially the same length as the stator or it may have a length less than the length of the stator. The component may be coupled to either the downhole or uphole end of the stator or it may be coupled to both. The component may include grooves, holes, or the like to provide paths for the flow of drilling fluid past the component. Such fluid flow paths can provide decreased restriction to fluid flow.

Figure 4:
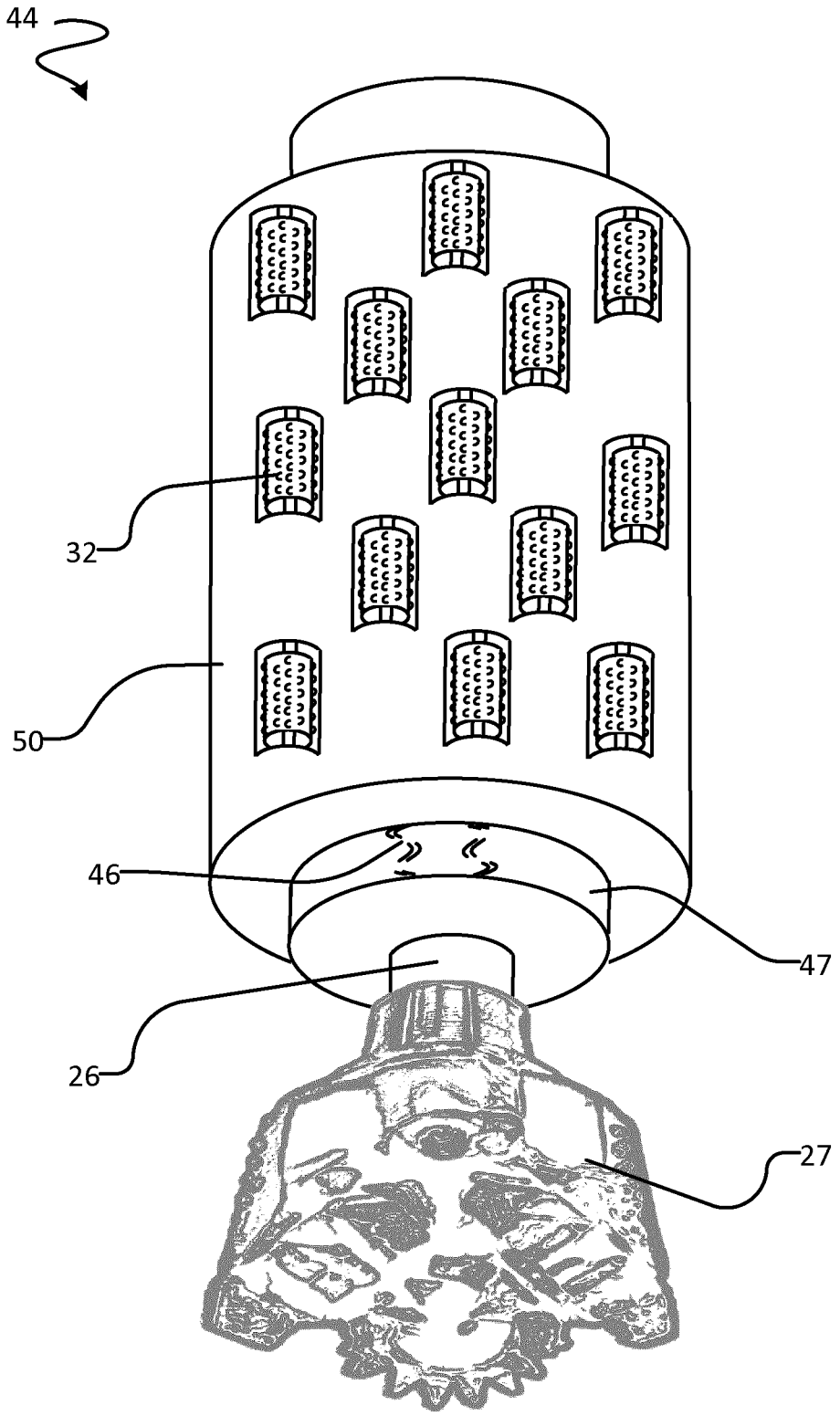
FIG. 4 is a schematic perspective view showing a mud motor and rotary reamer elements integrated into a sleeve coupled to the mud motor.

FIG. 4 shows schematically a mud motor 44 comprising a rotor 46 mounted to rotate within a stator 47 to drive a drill bit 27. A tubular sleeve 50 is clamped around stator 47. Reamer mechanisms 30 comprising rotatable reamer elements 32 are mounted to tubular sleeve 50. In other embodiments one or more tubular sleeves 50 are attached to a mud motor by bolts, a threaded coupling, one or more retaining rings, brazing, or the like.

Figure 4A:
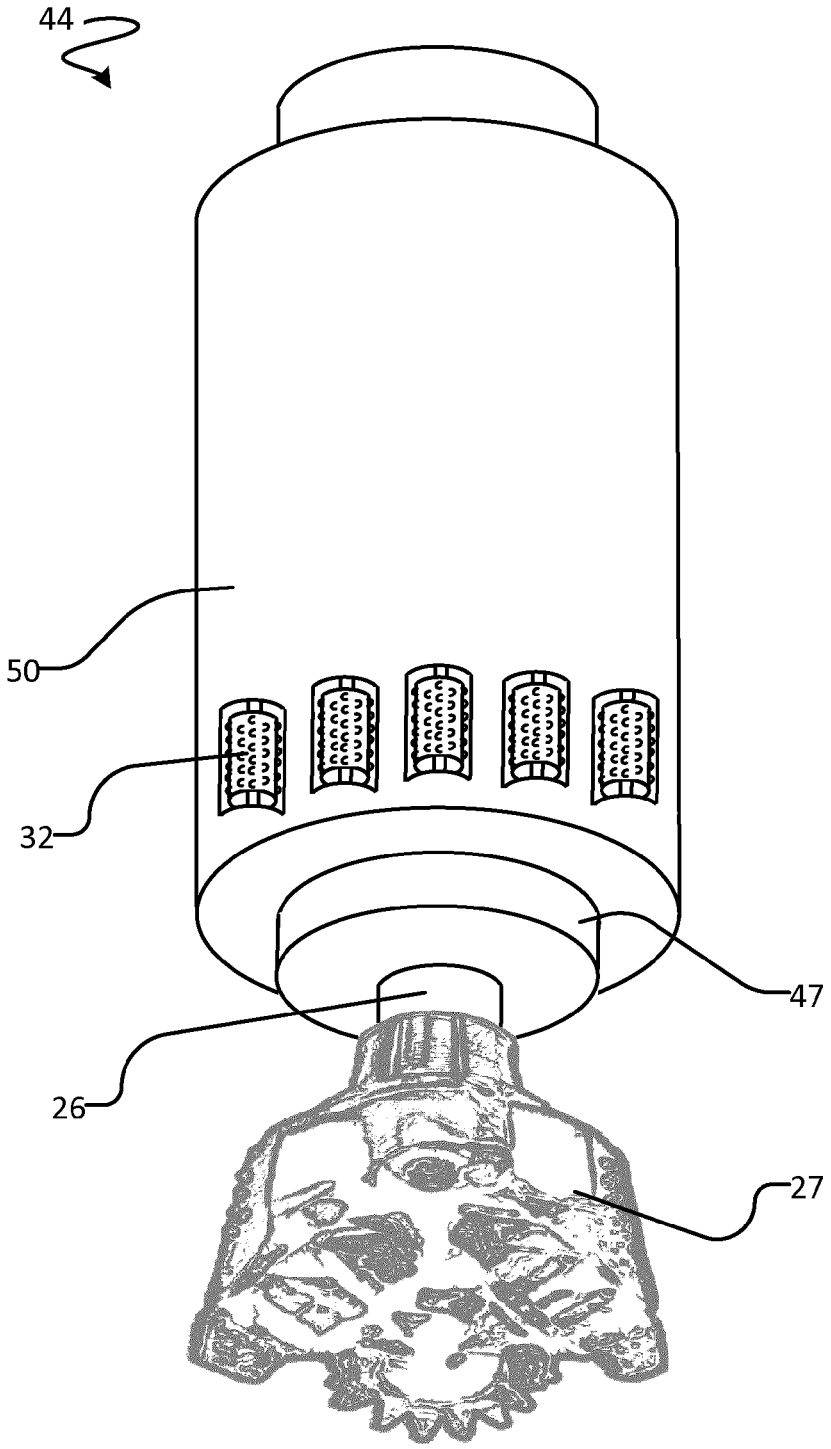
FIG. 4A is a schematic perspective view showing another embodiment of a mud motor and reamer elements integrated into a sleeve coupled to the mud motor.

In some embodiments, different tubular sleeves 50 having different arrangements of reamer mechanisms 30 may be provided for use with the same mud motor 44. For example, the different sleeves 50 may support mud motor 44 to different degrees against flexing. One tubular sleeve 50 may have reamer mechanisms 30 located near one end only while another tubular sleeve 50 may have several groups of reamer mechanisms 30 spaced longitudinally along it, see FIGS. 4 and 4A. As another example, two or more tubular sleeves 50 (which may be the same) may be provided. Tubular sleeves 50 may be in direct contact with each other. Alternatively, each of tubular sleeves 50 may be individually coupled to the stator so that they are spaced apart along the stator. When reamer elements 32 on one of the tubular sleeves become worn to the point that they should be refreshed, all of the reamer elements 32 may be replaced in one operation by removing and replacing the tubular sleeve 50 supporting the worn reamer elements 32 with another tubular sleeve 50 carrying fresh reamer elements 32.

As another example embodiment, different groups of reamer mechanisms 30 may be mounted on separate tubular sleeve sections. As reamer elements 32 wear, the tubular sleeve sections may be loosened, the tubular sleeve section carrying the most-worn reamer elements 32 may be removed, the other tubular sleeve sections may be slid along mud motor 44 and a tubular sleeve section carrying fresh reamer elements 32 may be installed in the resulting space.

Figure 5:
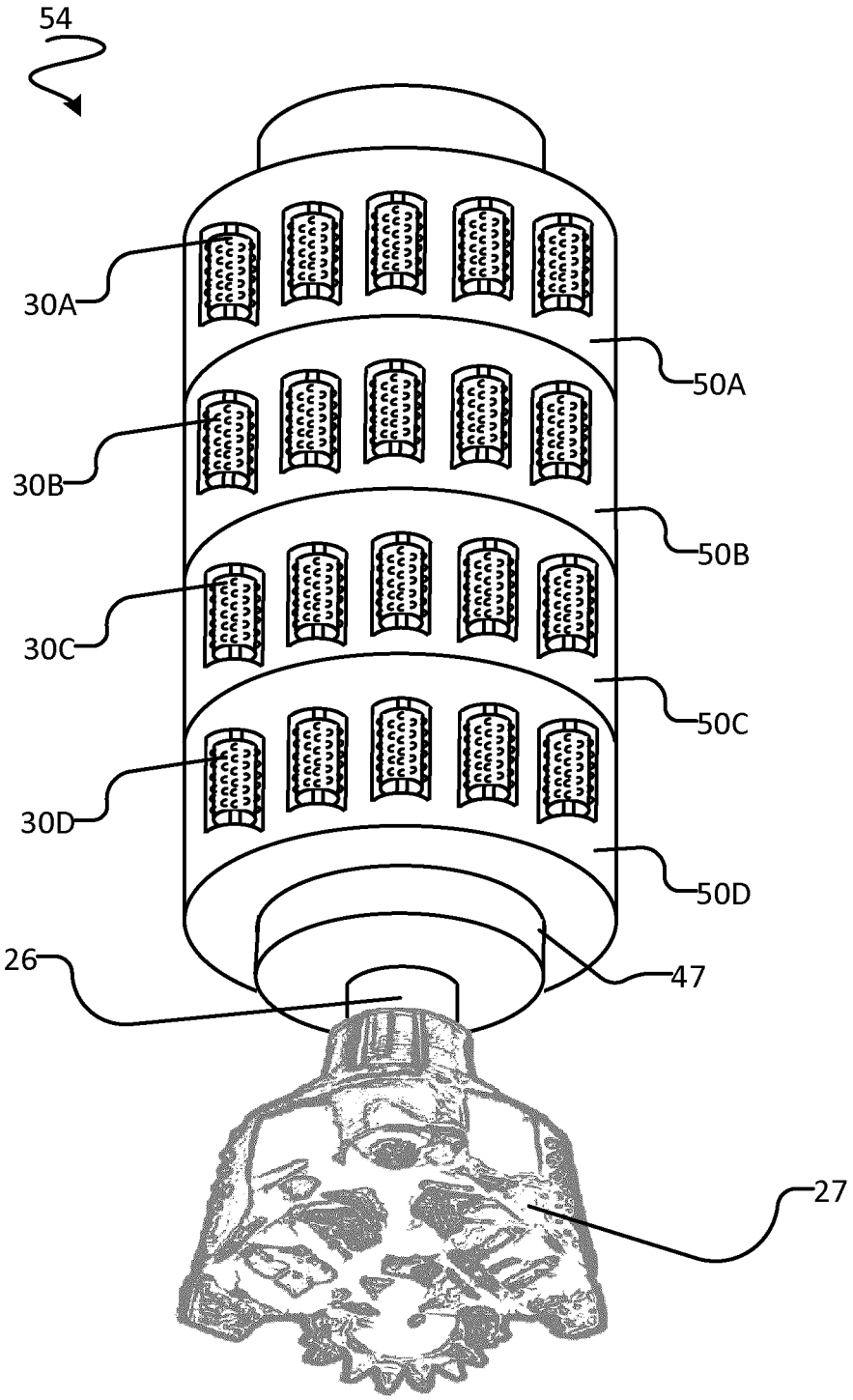
FIG. 5 is a schematic perspective view showing another embodiment of a mud motor and reamer elements integrated into a sleeve coupled to the mud motor.

FIG. 5 shows schematically a mud motor 54 according to an example embodiment wherein a first group made up of reamer mechanisms 30A is mounted on a first tubular sleeve section 50A coupled to body 55 of mud motor 54, a second group made up of reamer mechanisms 30B is mounted on a second tubular sleeve section 50B coupled to body 55 of mud motor 54, a third group made up of reamer mechanisms 30C is mounted on a third tubular sleeve section 50C coupled to body 55 of mud motor 54, and a fourth group made up of reamer mechanisms 30D is mounted on a fourth tubular sleeve section 50D coupled to body 55 of mud motor 54.

One advantage of certain of the embodiments described herein is that providing rotary reamers on a mud motor can simultaneously stabilize the mud motor and ream the borehole to provide a smooth-walled on-size borehole as drilling progresses. Providing a reamed borehole can reduce sliding friction of the drill string.

FIGS. 6A to 7B show an example alternative reamer device 60 that may be used together with reamer elements 30. Reamer devices 60 may be mounted to a mud motor or mounted at couplings elsewhere in a drill string. In addition to being useful together with reamer elements 30, reamer devices 60 are capable of independent application wherever a reamer is desired in a drill string.

Figure 6A:
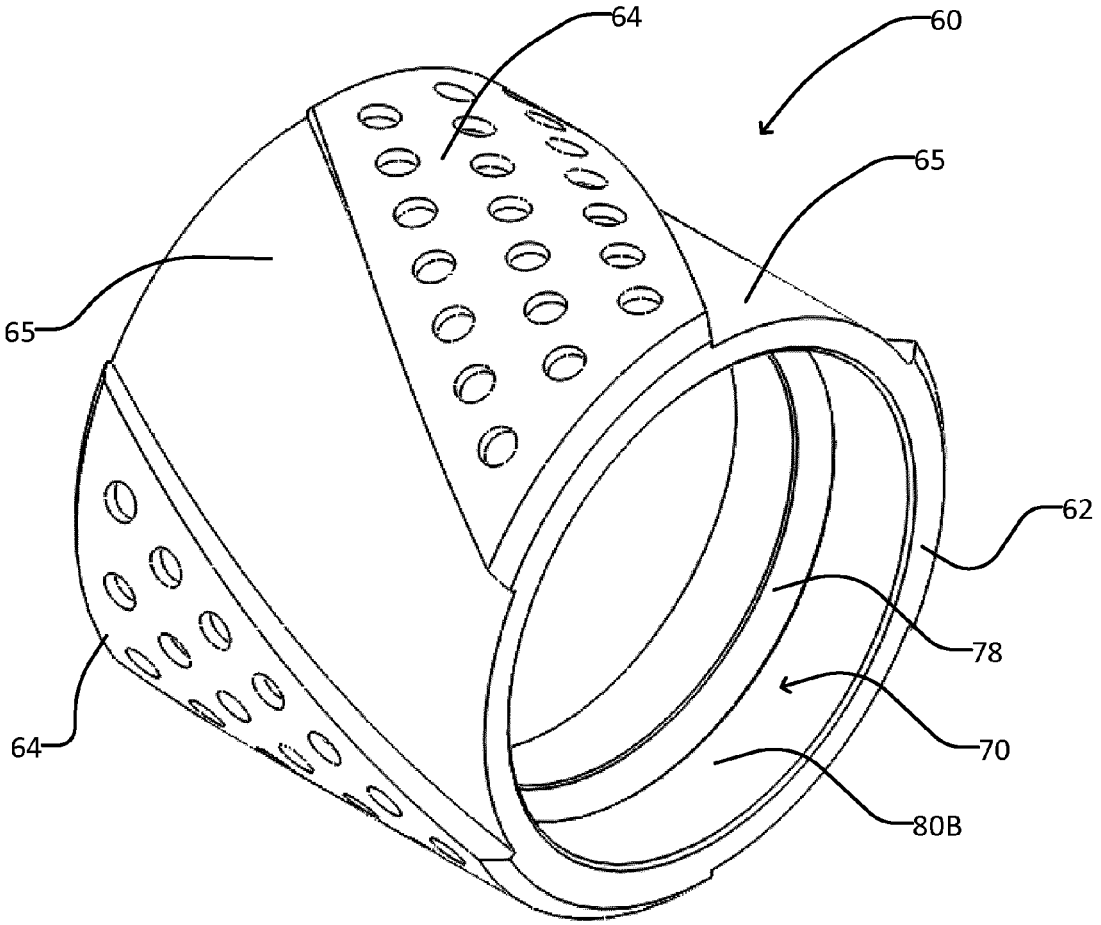
FIGS. 6A, 6B, and 6C are, respectively, perspective, side elevation, and longitudinal cross-section views of an alternative reamer device.
Figure 6B:
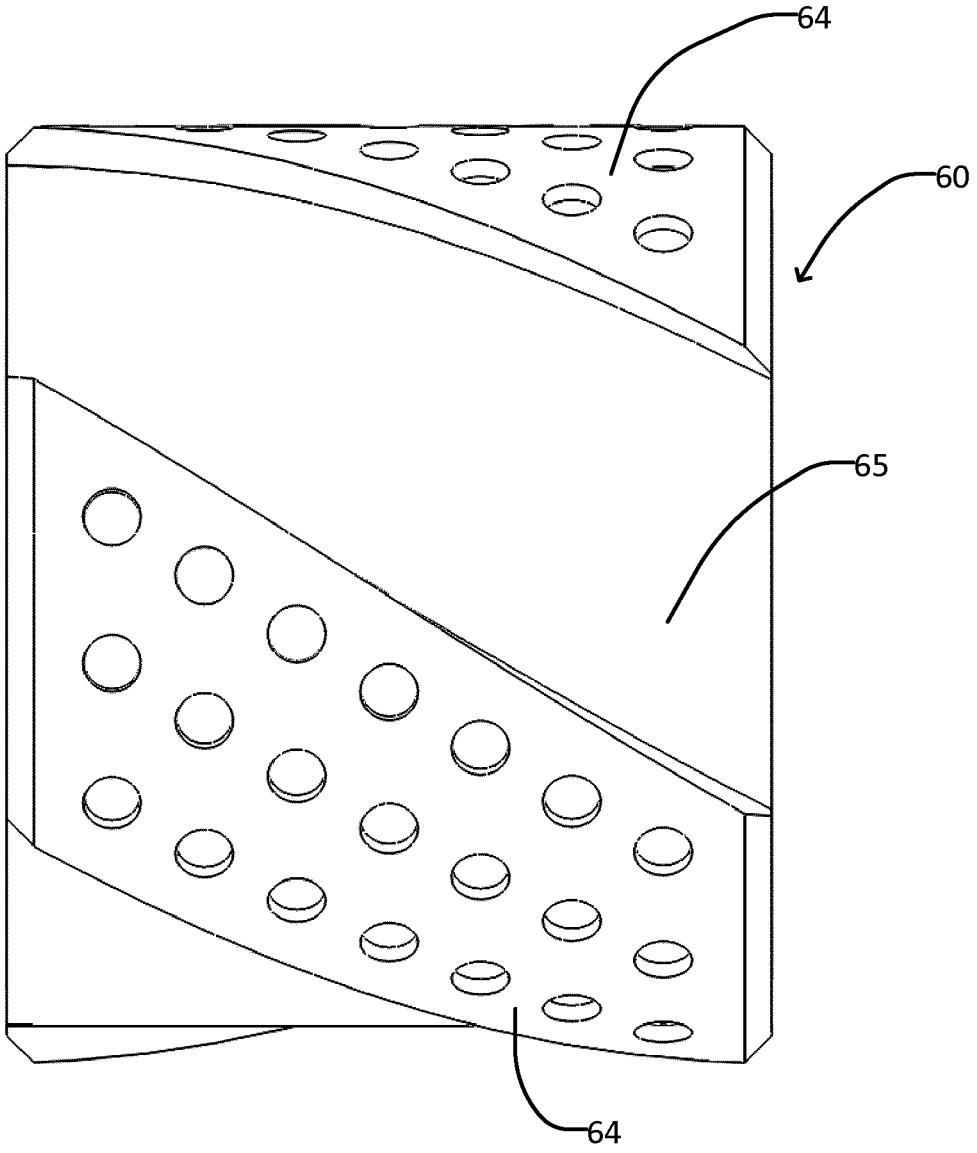
Figure 6C:
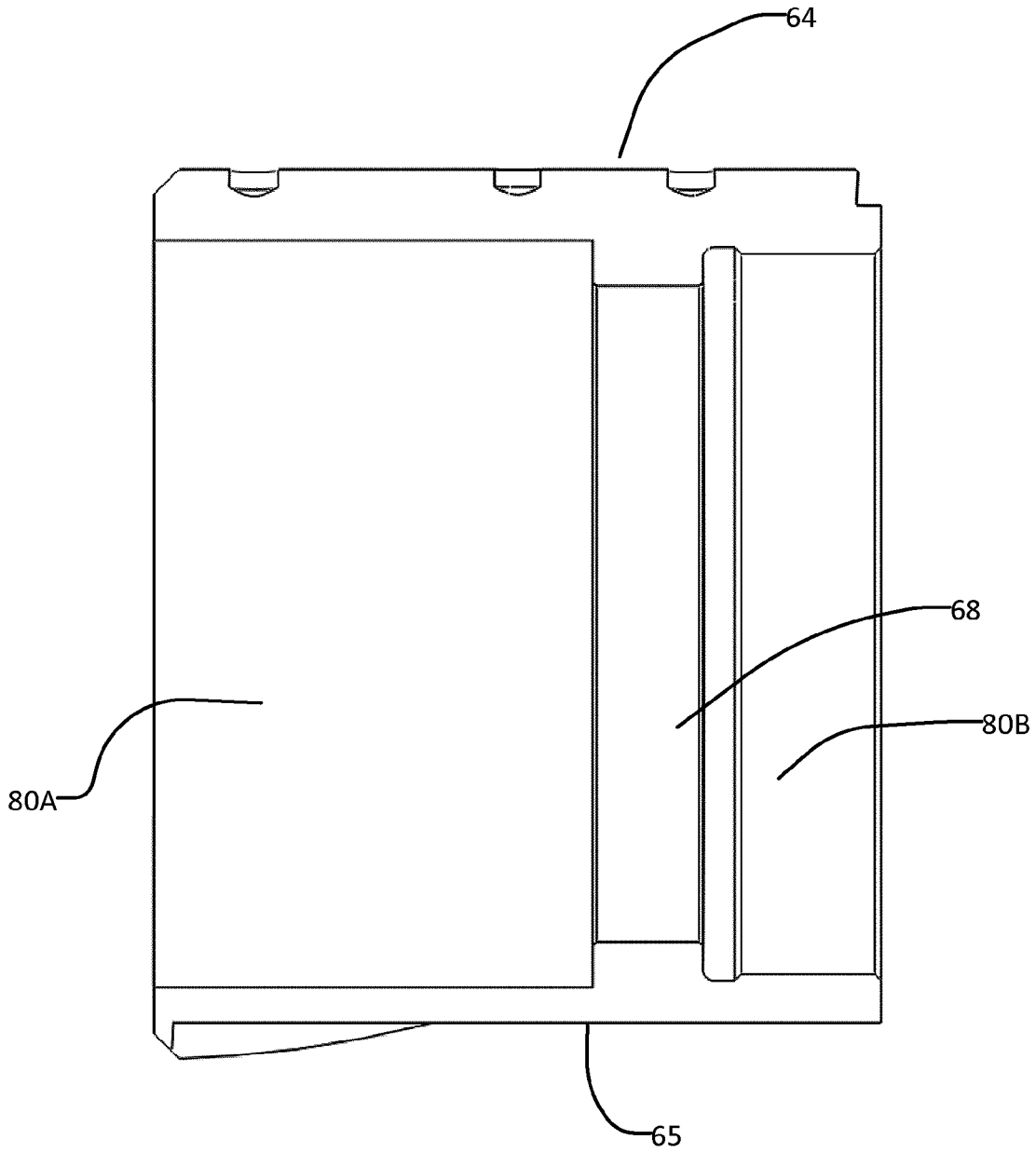

As shown in FIGS. 6A to 6C, reamer 60 comprises a reamer body 62 faced with hardened reaming surfaces 64. Reaming surfaces 64 may comprise, for example, surfaces carrying inserts of super hard materials such as tungsten-carbide, diamond-carbide, or the like. Grooves 65 between surfaces 64 facilitate the flow of drilling fluid past a reamer device 60. In an alternative embodiment, reaming surfaces are provided by rotatable reamer elements (for example like reamer elements 30 described above). Such rotatable reamer elements may be mounted to reamer body 62 in the manner and/or in arrangements as described in any of the embodiments above. Pockets may be formed in reamer body 62 to accept such rotatable reamer elements.

As shown in FIG. 6C, reamer device 60 comprises a bore 70. Couplings of two drill string sections may be inserted from opposing ends of bore 70 and the couplings coupled together (see FIG. 7B) so that the drill string extends through bore 70 of reamer device 60.

In the illustrated embodiment a first section 72 carrying a female coupling 73 is coupled to a second section 74 carrying a male coupling 75. When female coupling 73 and male coupling 74 are connected together, a gap 76 is left between the end of first section 72 and a shoulder 77 on second section 74. Reamer element 60 has an inwardly-projecting member 78 that engages in gap 76 to hold reamer device 60 in place. In the illustrated embodiment, gap 76 is circumferential and member 78 comprises an inwardly-projecting flange but this is not mandatory. Where gap 76 is circumferential, reamer device 60 may be free to rotate relative to the coupled sections 72, 74.

Bore 70 of reamer device 60 has inner surfaces 80A and 80B dimensioned to bear against corresponding outer surfaces 81A and 81B on first and second sections 72, 74. The engagement between at least one of sections 80A and 80B with the corresponding section 81A or 81B assists in keeping reamer device 60 stabilized and concentric with the drill string.

Reamer device 60 may optionally be attached to sections 72, 74 in a way that prevents or limits rotation. For example, reamer device 60 may be threaded in section 80A or section 80B and the corresponding section 81A or 81B may also be threaded (e.g. provided with external threads) such that reamer device 60 may be threadedly coupled to one of sections 71, 72 and then the other of sections 72, 74 may be introduced through bore 70 and couplings 73 and 75 coupled together. Other non-limiting constructions to prevent or limit rotation of reamer device 60 relative to sections 72, 74 include suitable pins, bolts, clamps, etc.

Figure 7A:
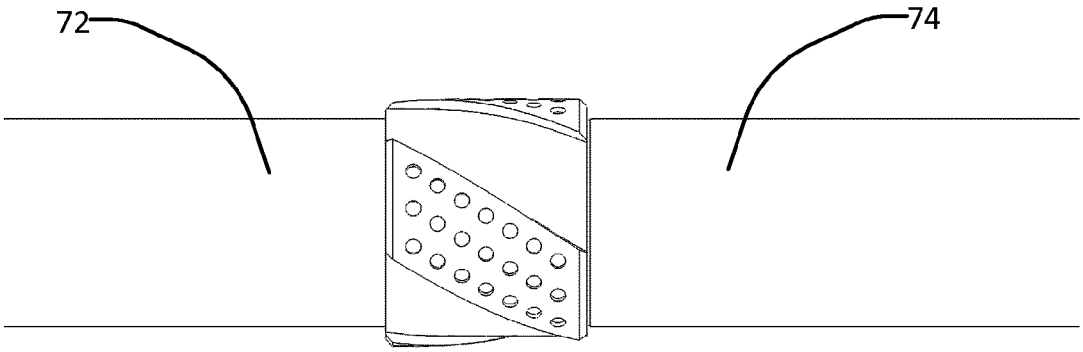
FIGS. 7A and 7B are, respectively, a side elevation view and a longitudinal cross-section view of a reamer device as shown in FIGS. 6A to 6C assembled between sections of a drill string.
Figure 7B:
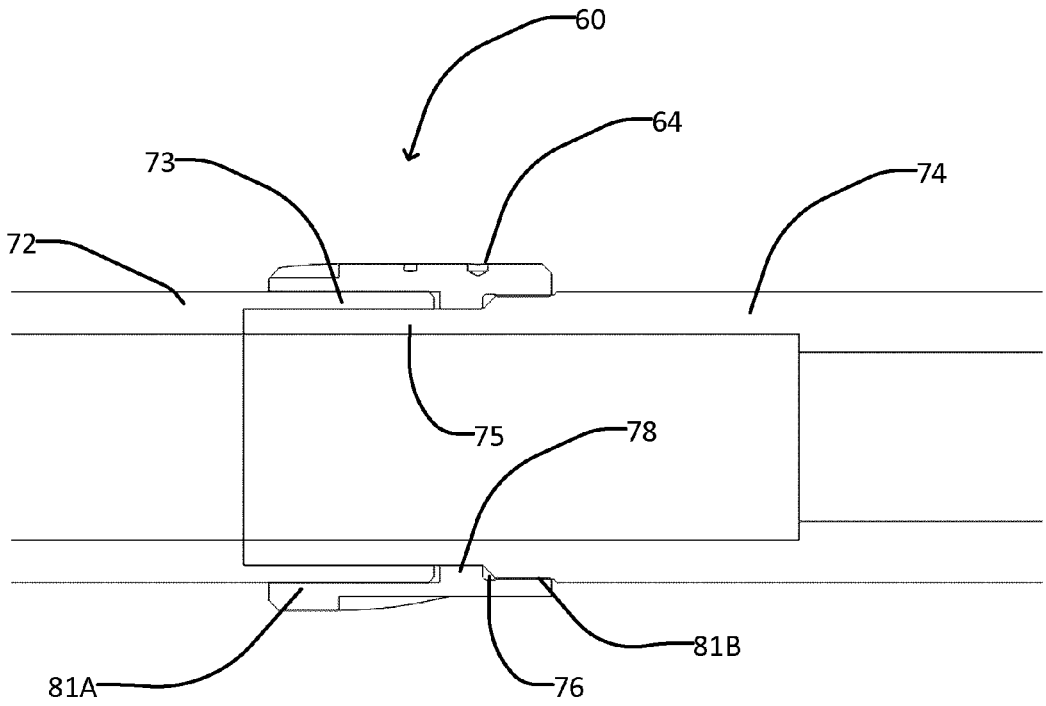

In some embodiments a mud motor comprises two or more sections coupled together by engaging couplings as shown, for example, in FIG. 7B and a reamer device 60 is mounted on the mud motor at the couplings.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A downhole reaming system comprising:

a reamer body carrying one or more radially-outwardly-facing reamer surfaces; and first and second drill string sections;

the reamer body having a bore extending therethrough, the bore comprising first and second inner surfaces respectively dimensioned to receive the first and second drill string sections and a radially-inwardly-projecting member within the bore between the first and second inner surfaces;

the reamer body assembled onto a joint between the first and second drill string sections, the first drill string section comprising a first coupling element engaged to a second coupling element of the second drill string section and providing a gap at the joint wherein the radially-inwardly-projecting member of the reamer body projects into the gap.

2. A reaming system according to claim 1 wherein the one or more reamer surfaces are surfaces of one or more reamer elements rotatably mounted on an outer surface of the reamer body.

3. A reaming system according to claim 2 wherein the reamer body carries a plurality of the reamer elements and the reamer elements of the plurality of reamer elements are each mounted in a corresponding pocket in the outer surface of the reamer body and each of the reamer elements projects radially outwardly from the corresponding pocket.

4. A reaming system according to claim 3 wherein the reamer elements of the plurality of reamer elements are each supported for rotation on a shaft extending across the corresponding pocket.

5. A reaming system according to claim 3 wherein the plurality of reamer elements include a group of three or more reamer elements spaced apart from one another around a circumference of the body.

6. A reaming system according to claim 5 wherein the reamer elements in the group of reamer elements are uniformly spaced apart around the circumference of the body.

7. A reaming system according to claim 1 wherein the reamer body carries a plurality of the reamer surfaces and the reamer body comprises grooves extending longitudinally along the reamer body between circumferentially adjacent ones of the reamer surfaces.

8. A reaming system according to claim 1 wherein the gap extends circumferentially around the joint and the reamer device is rotatable about the first and second drill string sections.

9. A reaming system according to claim 8 wherein at least one of the first and second drill string sections comprises a mud motor housing.

10. A reaming system according to claim 1 wherein at least one of the first and second drill string sections comprises a drill collar.

11. A reaming system according to claim 10 wherein the reamer body has internal threads engaging external threads on the drill collar.

12. A reaming system according to claim 1 wherein the radially-inwardly-projecting member comprises an inwardly-projecting flange.

13. A reaming system according to claim 1 wherein the first coupling element comprises a female coupling and the second coupling element comprises a male coupling.

* * * * *